United States Patent [19]

Burgess

[11] Patent Number: 4,766,353

[45] Date of Patent: Aug. 23, 1988

[54] LAMP SWITCHING CIRCUIT AND METHOD

[75] Inventor: David E. Burgess, Torrance, Calif.

[73] Assignee: Sunlass U.S.A., Inc., Torrance, Calif.

[21] Appl. No.: 33,816

[22] Filed: Apr. 3, 1987

[51] Int. Cl.[4] ..... H05B 41/22

[52] U.S. Cl. ..... 315/324; 315/362; 315/321; 315/DIG. 4; 315/314; 315/315

[58] Field of Search ..... 315/82, 88, 90, 89, 315/314, 322, 324, 315, 321, 362, DIG. 4

[56] References Cited

U.S. PATENT DOCUMENTS

| | | | |
|---|---|---|---|
| 2,076,278 | 4/1937 | Ryde et al. | 315/324 |
| 3,676,734 | 7/1972 | Shimizu et al. | 315/324 |
| 3,814,947 | 6/1974 | Friedman | 315/88 |
| 4,238,711 | 12/1980 | Wallot | 315/324 |
| 4,475,062 | 10/1984 | Radenkovich et al. | 315/90 |
| 4,625,152 | 11/1986 | Nakai | 315/324 |

*Primary Examiner*—David K. Moore

*Assistant Examiner*—M. Powell

*Attorney, Agent, or Firm*—Robert J. Schaap

[57] ABSTRACT

A lamp switching circuit and method for selectively energizing one or more lamps of a bank of lamps and thereafter energizing other of the lamps when power is interrupted and next applied. The lamp switching circuit and method is also effective in selectively and sequentially operating one or more ballasts in a group of ballasts which, in turn, operate one or more lamps in a circuit arrangement. The lamps with which the present invention is used are typically phosphor excitable lamps, such as flourescent lamps. In this way, power consumption is reduced, even through lumen output is correspondingly reduced. However, by selectively and sequentially energizing only certain of the lamps in a circuit arrangement, the overall life of the lamps is materially increased. Moreover, the lamps will operate with the same degree of efficiency as they would operate if all lamps connected to a ballast were operating.

30 Claims, 13 Drawing Sheets

C
S6
S5
S4
S3
S2
S1
66
32
38
42
40
28
30
36
44
56
54
52
50
BLUE-LAMP
RED-LAMP
BLUE LAMP
RED-LAMP
RED-BALLAST
RED-BALLAST
48
46

LAMP SWITCHING CIRCUIT AND METHOD

BACKGROUND OF THE INVENTION

1. Field of the Invention

This invention relates in general to certain new and useful inprovements in lamp switching circuit devices and method and more particularly to a lamp switching circuit device and method which sequentially energizes one or more lamps in a circuit arrangement without impairing the efficiency of operation of any of the lamps when operating.

2. Brief Description of the Prior Art

In many cases, conventional fluorsecent light fixtures are constructed so as to physically retain and energize a pair of phosphor excitable lamps, such as fluorescent lamps. The ballast and circuitry in these fixtures are typically designed so that the two lamps in the fixture are essentially electrically 180 degrees out of phase. This arrangement is used in order to cancel out visible flicker to some extent. Thus, two lights in a fixture or otherwise lights in pairs are employed to reduce the noticeable effects of flicker, even though the extra lumen output of two lamps in not necessarily required.

In many cases, it has been found in office buildings and other commercial installations, that it is possible to eliminate one or more lamps of the fixture without appreciably reducing total light output so that inefficiency and eye fatigue do not result. In other words, many commercially available fixtures were constructed so that an excess of light was generated for a given purpose.

In recent years, and due to at least in part to severe shortages in available energy, and particularly electrical energy, and also due to the high cost of electrical energy, there has been an interest in reducing the available light output in order to reduce the total cost of operation. However, in many of the commercially available fluorescent lamp fixtures, the removal of one of the lamps, particularly in a series connected circuit of the lamps, resulted in a very substantial inefficiency of operation. If the remaining lamp was able to operate at all, depending upon the circuit configuration, then there was a resultant inefficiency in that the remaining lamp produced less light output for a given level of power consumption or otherwise the ballast in the electrical circuit which operated the lamp operated inefficiently thereby decreasing operating life.

In order to obviate these problems, there has been some use of the so-called "phantom tube", that is, a lamp tube which is similar in appearance and size to a conventional fluorsecent lamp but which does not generate any lumen output and similarly, does not utilize any electrical power, as such. Lamps of this circuit arrangement to compensate for the missing lamp. Lamps type utilize an interior capacitor which is introduced in the of this type are described in U.S. Pat. No. 3,956,665 to Westphal and U.S. Pat. No. 4,255,692 to David E. Burgess. Other lamp substitute devices are also shown in U.S. Pat. No. 4,348,614 to David E. Burgess.

The devices of the aforementioned type were oftentimes ineffective, if not undesirable. Due to the fact that only one of the lamps in the circuit was operating, and moreover, due to the fact that this lamp had to accept any increased load factor as a result of one lamp missing, the overall life span of the remaining lamp was materially reduced. In large institutions where numerous fluorsecent lamps are employed, this necessitated frequent changing of the lamps which materially increased the overall maintenance cost of the light systems.

There have been other proposed arrangements for reducing the amount of light in an attempt to reduce the energy consumption and cost of light operation. For example, fixed static dimmers were introduced to work in conjunction with the ballast circuit for reducing power consumption and light output in applications where the reduced light was acceptable. Further, more sophisticated controllers were also designed and which utilized microprocessor control for turning light systems on and off based on work shedules within a facility. Other controllers were designed to provide minimal light by distinguishing all but a very few of the lights within a circuit.

In an attempt to also increase the light output from a light fixture while de-energizing one of the lamps therein, there have been attempts to use highly reflective metal and plastic surfaces on portions of the fixtures for reflecting the light from the remaining lamps which operate. These reflectors are formed with a contour so as to amplify the light from the fixture and direct it into a usable surface area in an optimum manner. These reflective surfaces are also effective in that they enhance the reflective characteristics within and around the fluorsecent lamps, whether or not operating, so that it appears that all lamps in a fixture are operating when only certain of the lamps may, in fact, be generating the light output.

One of the principal problems which has been encountered in the prior art by de-energizing some of the lamps and maintaining the energization of other of the lamps is the reduced life span of the lamps which are operating. As an example, the practicality of maintaining a four lamp, two ballast fluorescent fixture requires that all lamps must be replaced in about an every three year period because they will have utilized their effective 12,000 to 20,000 hours of expected operating life. If any one of the lamps in that ballast are removed or de-energized, the maintenance time may increase somewhat. Nevertheless, even if the maintenance time does not increase, when one lamp in a two lamp ballast burns out, there is an urgency introduced into the maintenance.

There is needed a switching circuit which will effectively and sequentially energize only certain of the lamps in a lighting fixture and sequentially thereafter energize the other of the lamps in the fixture when power is interrupted and reapplied. In this way, optimum use of the lamps is obtained and optimum maintenance schedules are achieved.

OBJECTS OF THE INVENTION

It is, therefore, one of the primary objects of the present invention to provide a lamp switching circuit for selectively and sequentially energizing only certain of the lamps in a lamp operating circuit and thereafter energizing the other lamps in the circuit when power is interrupted and reapplied.

It is an additional object of the present invention to provide a lamp switching circuit device of the type stated which is capable of operating certain of the lamps in a fixture without any decrease in the efficiency of operation of the remaining and operating lamps.

It is a further object of the present invention to provide a lamp switching circuit device of the type stated which effectively reduced power consumption by correspondingly reducing lumen output, but which still maintains the high degree of efficiency of operation of the operating lamps.

It is also an object of the present invention to provide a lamp switching circuit of the type stated which eliminates problems of increased maintenance as a result of de-energizing one or more lamps in a circuit arrangement.

It is still another object of the present invention to provide a lamp switching circuit device of the type stated which can be added to an existing circuit arrangement as a retro-fit device or which can be incorporated in a new lamp operating circuit.

It is another salient object of the present invention to provide a circuit device of the type stated which permits de-energization of certain of the lamps in a ballast circuit without physically disconnecting those lamps.

It is yet another object of the present invention to provide a method of operating a plurality of phosphor excitable lamps and a ballast in circuit arrangement by effectively energizing only one or more of the lamps in the circuit arrangement while maintaining a de-energization of other of the lamps in the circuit arrangement and thereafter sequentially energizing the other of the lamps when power is interrupted and reapplied.

With the above and other objects in view, my invention resides in the novel features of form, construction, arrangement, and combination of parts presently described and pointed out in the claims.

BRIEF SUMMARY OF THE DISCLOSURE

The present invention provides a lamp switching circuit device for connection in a circuit arrangement with a plurality of phosphor excitable lamps, such as fluorescent lamps, and a ballast for operation of these lamps. The switching circuit device comprises a first connecting means which connects the circuit device to the ballast and which ballast is also connected to receive electrical power from a source thereof to generate a lamp operating voltage. A second connecting means is provided for connecting the circuit device to the phosphor excitable lamps.

Each of the circuit devices comprise a switching means for causing the lamp operating voltage from that ballast to be delivered to at least one of the pair of lamps but not to the other of the pair of lamps. The switching device also comprises a relay means which is operatively connected to the switching means to activate the switching means to enable delivery of the lamp operating voltage to the opposite of the pair of lamps when the power is interrupted and again turned on to the ballast.

In a more preferred embodiment, the relay means comprises a set relay coil and a reset relay coil which are operable in conjunction with each other. Moreover, the set relay coil and the reset relay coil are connected in a series arrangement and each are provided with diodes connected across each coil.

The switching means forming part of the circuit device preferably comprises a four pole, double throw switch in which the switch is connected to the relay coil and to the one or more lamps and the ballast.

In one embodiment of the invention, the circuit device is used with a plurality of lamps, such as a pair of lamps in a fixture, connected to a single ballast. The circuit device causes one of the lamps to be operated when electrical power is supplied to the ballast and causes the other of the lamps to be operated when electrical power is interrupted and next supplied to the ballast.

In another embodiment, the lamp switching circuit device of the present invention operates with a pair of ballasts such that each ballast is connected to and operates a pair of lamps. In this case, the circuit device causes the lamps powered by one of the ballasts to be operated when power is supplied and causes the lamps powered by the other of the ballasts to be operated when power is interrupted and next supplied.

The circuit device of the present invention is constructed so that it can be connected in circuit arrangement between a ballast and a plurality of lamps of an existing circuit. Moreover, the device of the present invention may actually form part of a ballast arrangement such that a new ballast, when installed, will automatically have the switching circuit device incorporated therein.

The lamp switching circuit device of the present invention is also operable with a large number of ballasts and a large number of circuit arrangements. For example, the circuit device can be operated with a high power factor two lamp ballast or a normal power factor two lamp ballast or a high power factor one lamp ballast. In addition, the circuit arrangement may be operable with a two lamp ballast capable of operating four lamps in a circuit arrangement and with a pair of ballasts operating four lamps in a circuit arrangement.

In still a further embodiment of the present invention, the lamp switching circuit device operates in such a manner that it will, statistically, on the average energize each one of the lamps in a circuit such that on the average, each of the lamps are energized about 50% of the time that power is supplied to the circuit arrangement.

This invention possesses many other advantages and has other purposes which will be made more clearly apparent from a consideration of the forms in which it may be embodied. These forms are shown in the drawings forming a part of and accompanying the present specification. They will be described in detail for purposes of illustrating the general principles of the present invention, but it is to be understood that such detailed description is not to be taken in a limiting sense.

BRIEF DESCRIPTION OF THE DRAWINGS

Figure 1:
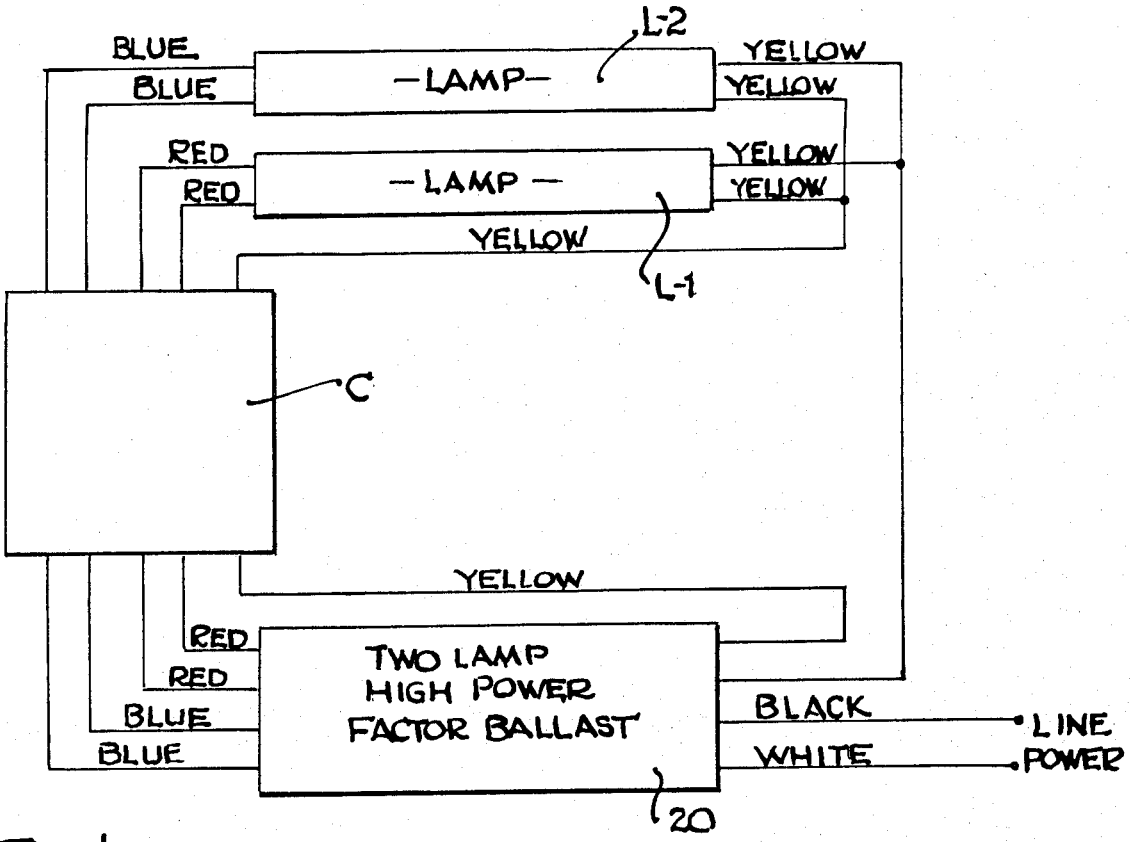
Figure 3:
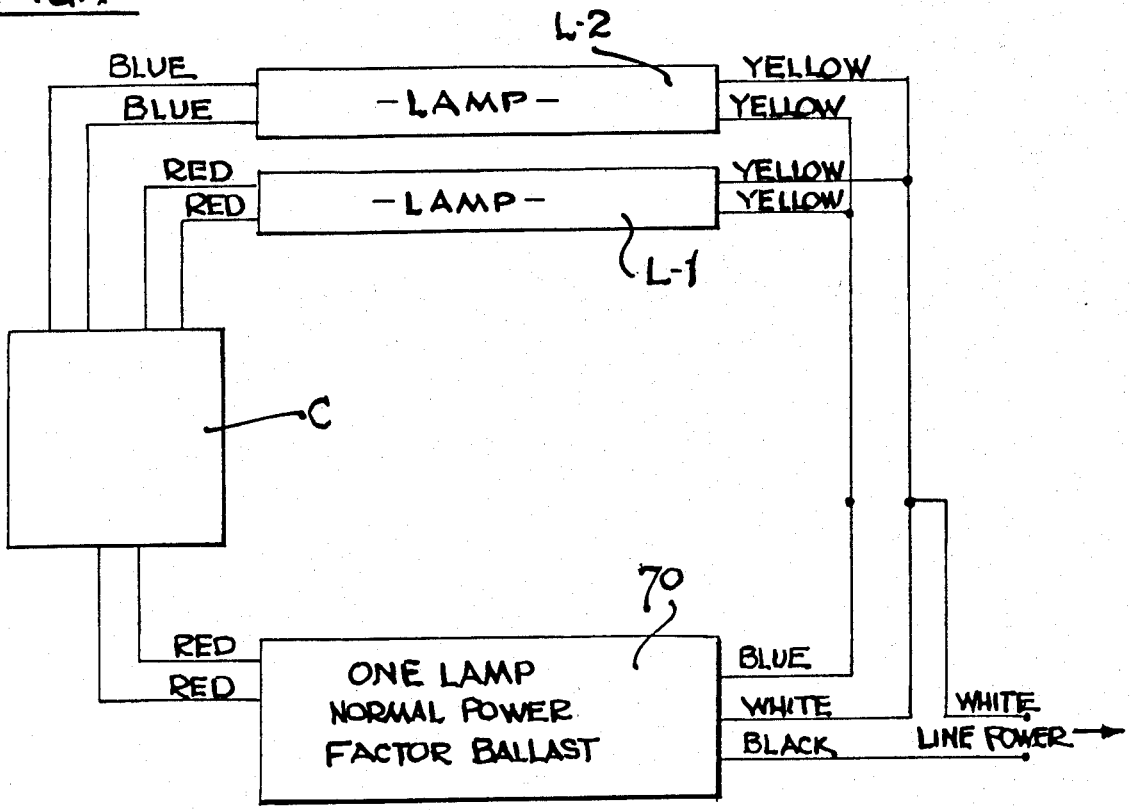
Figure 2:
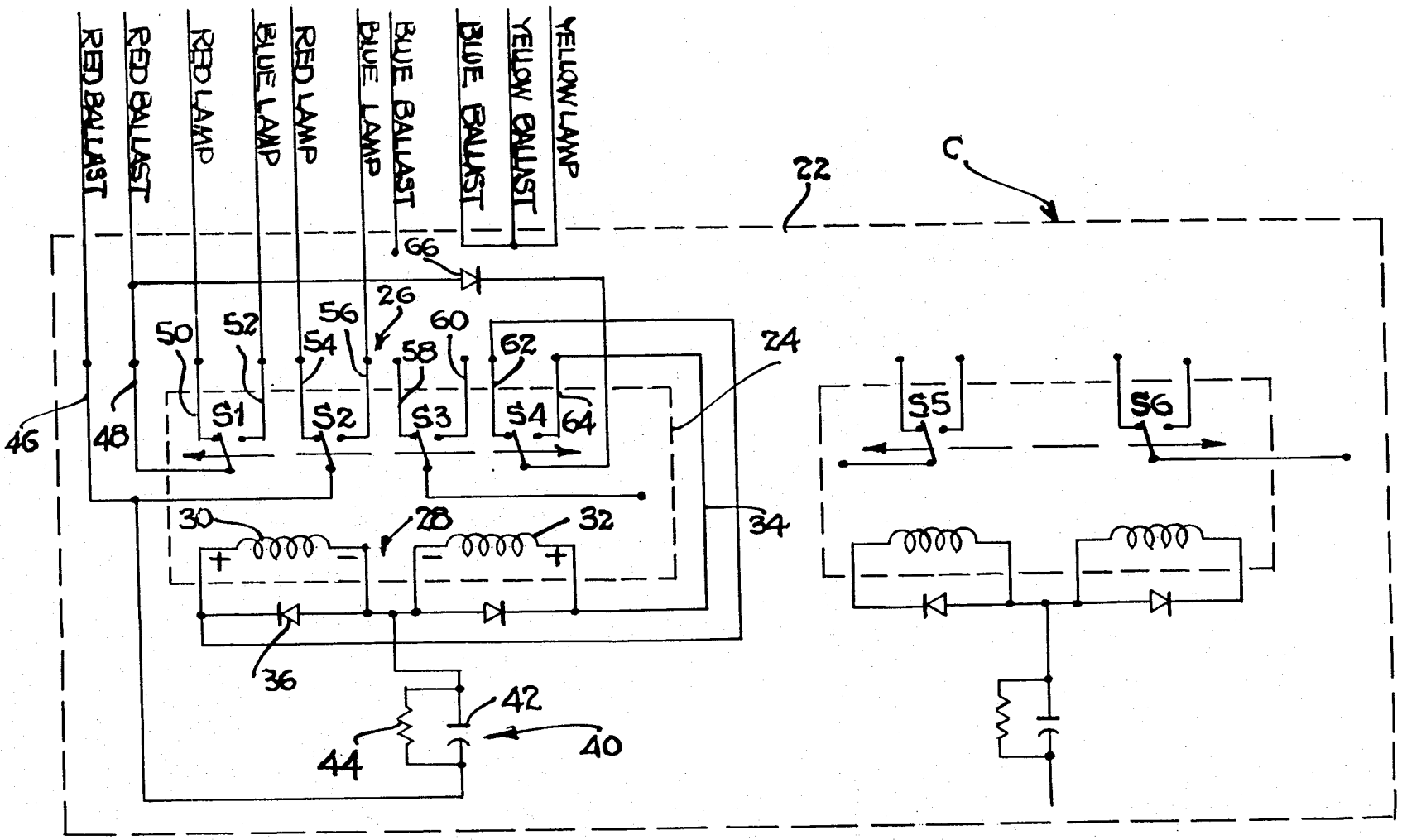
Figure 4:
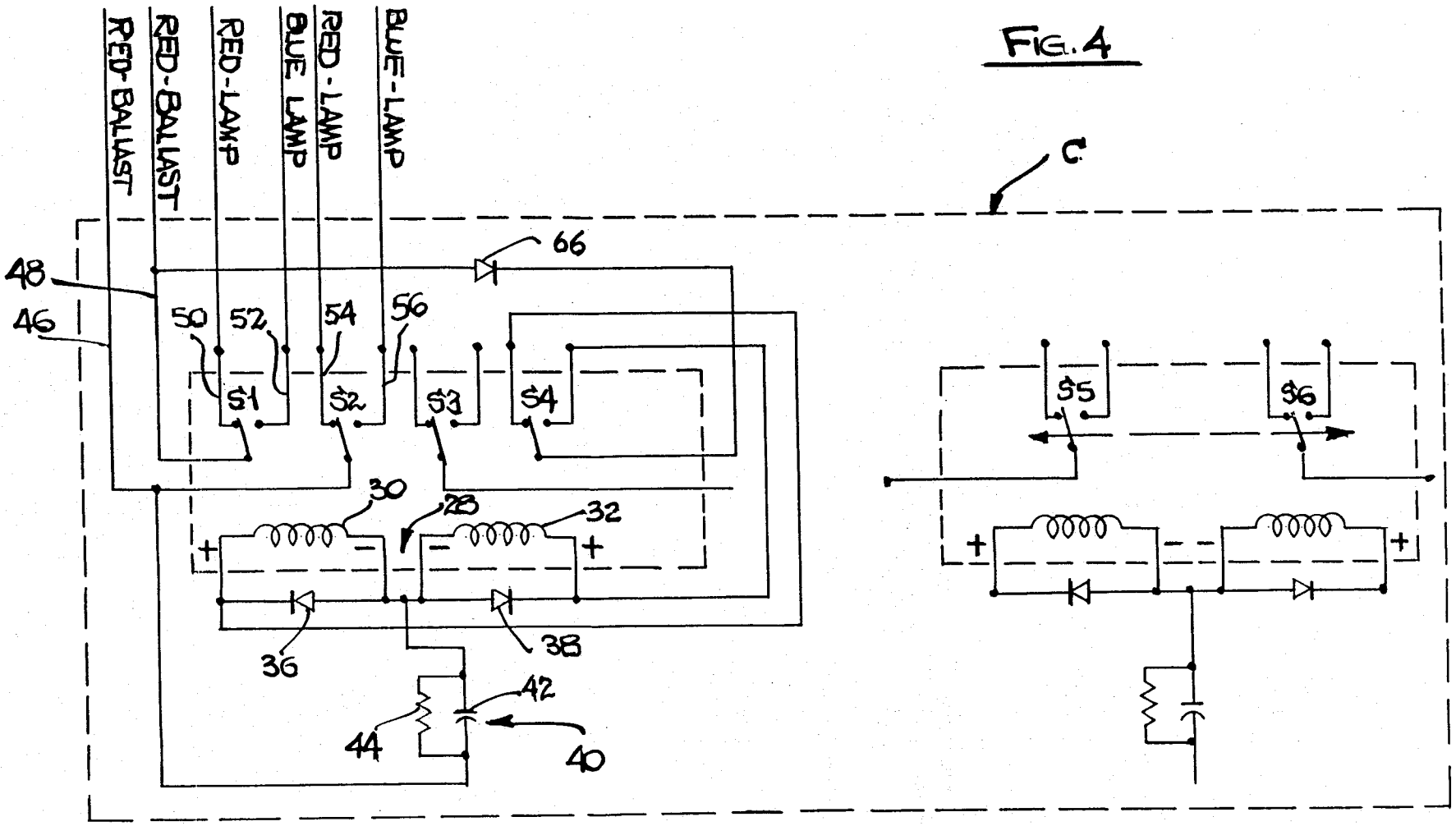
Figure 5:
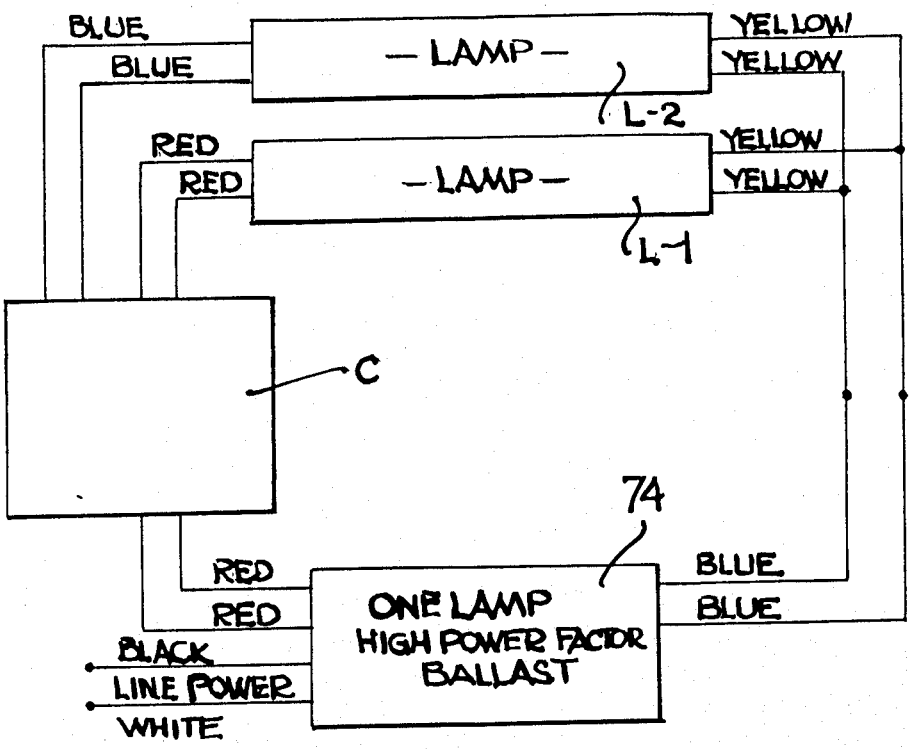
Figure 7:
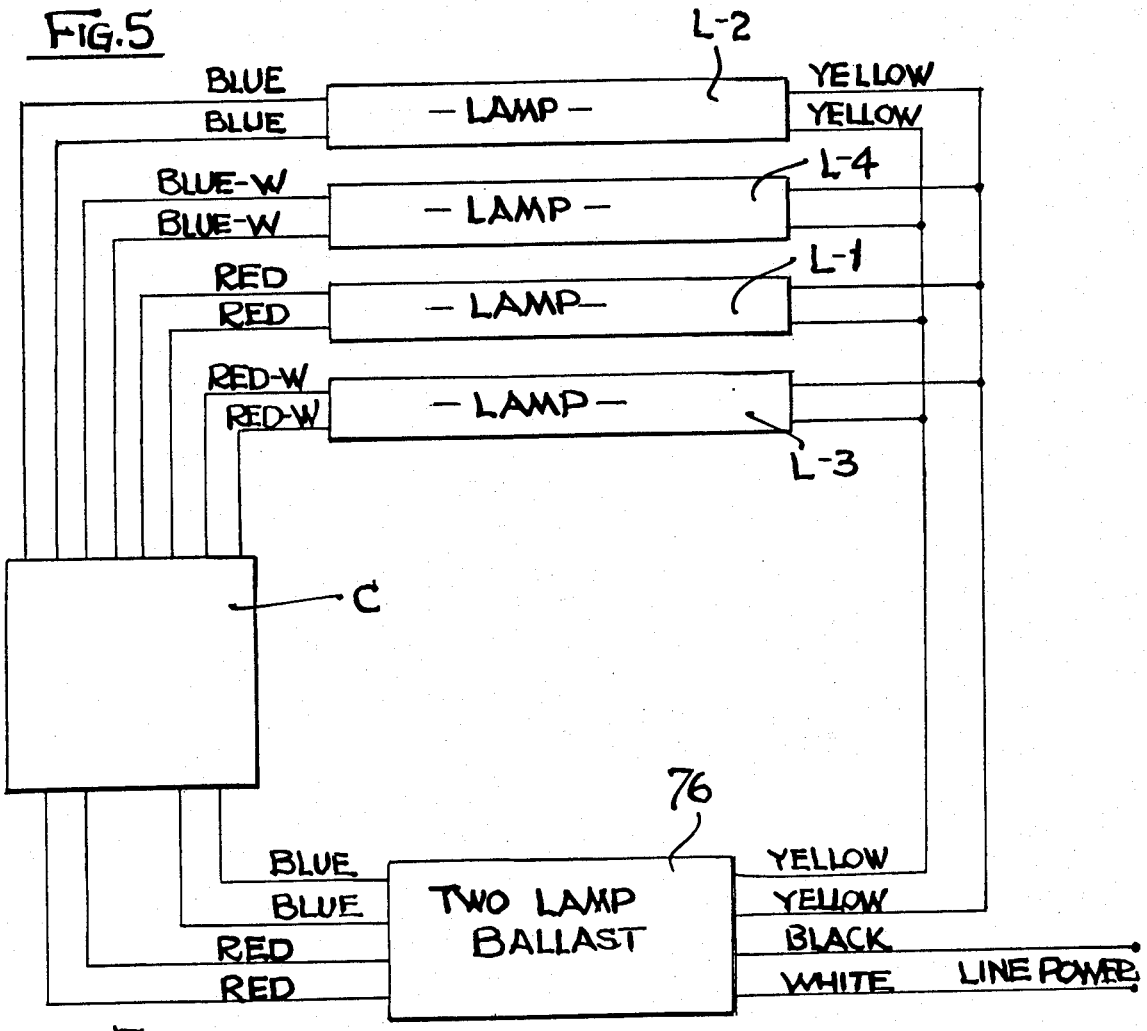
Figure 6:
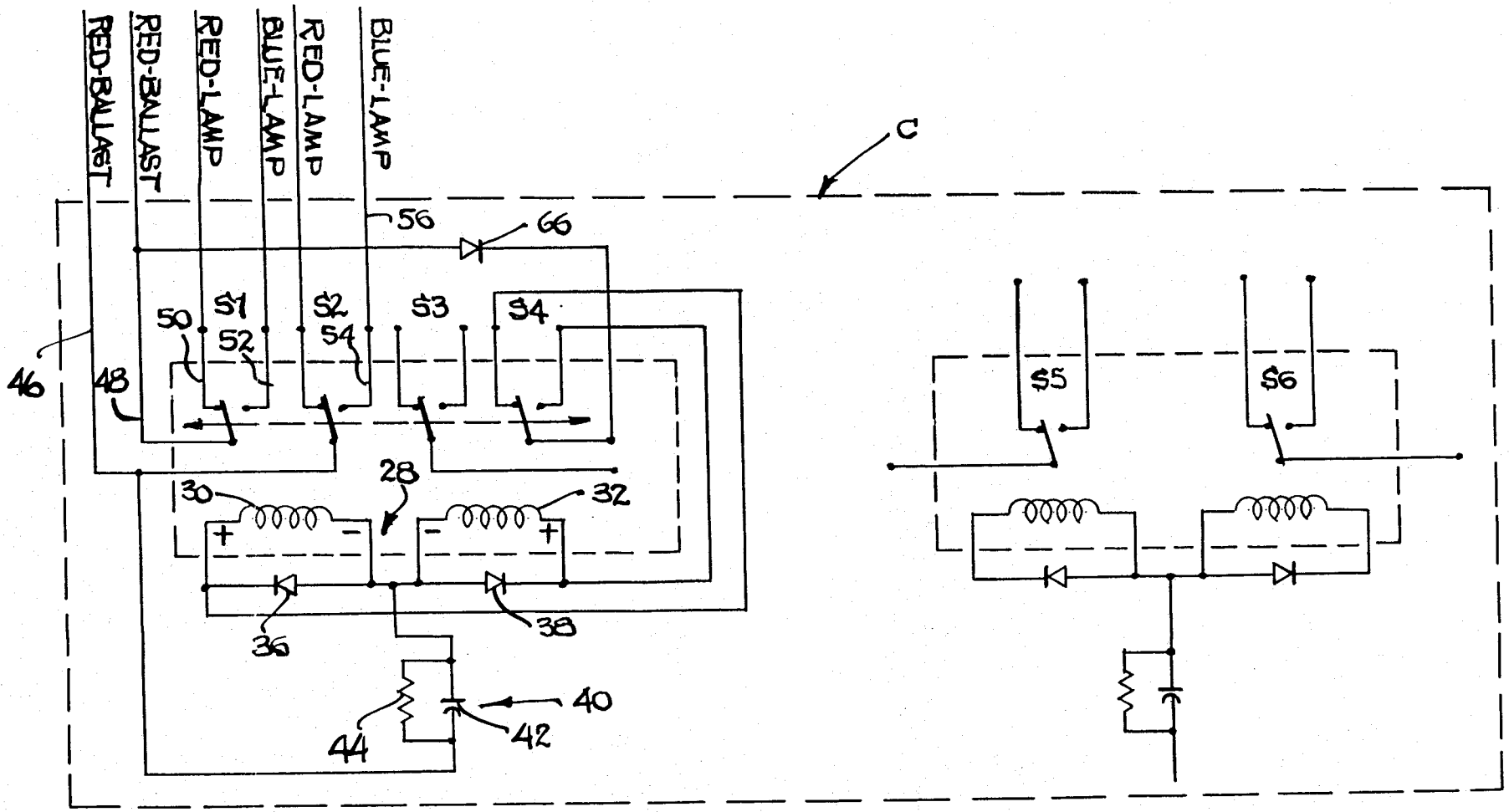
Figure 8:
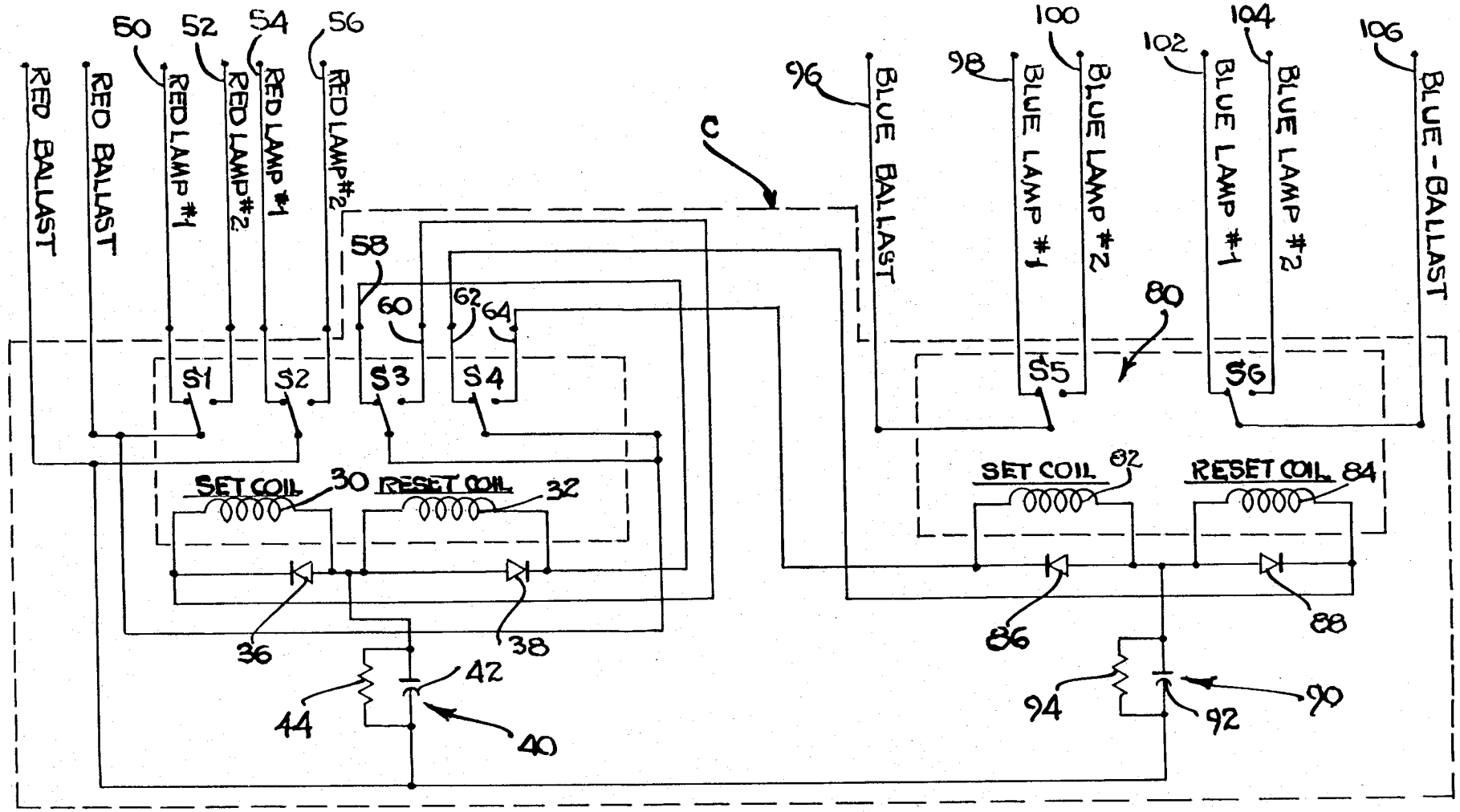
Figure 9:
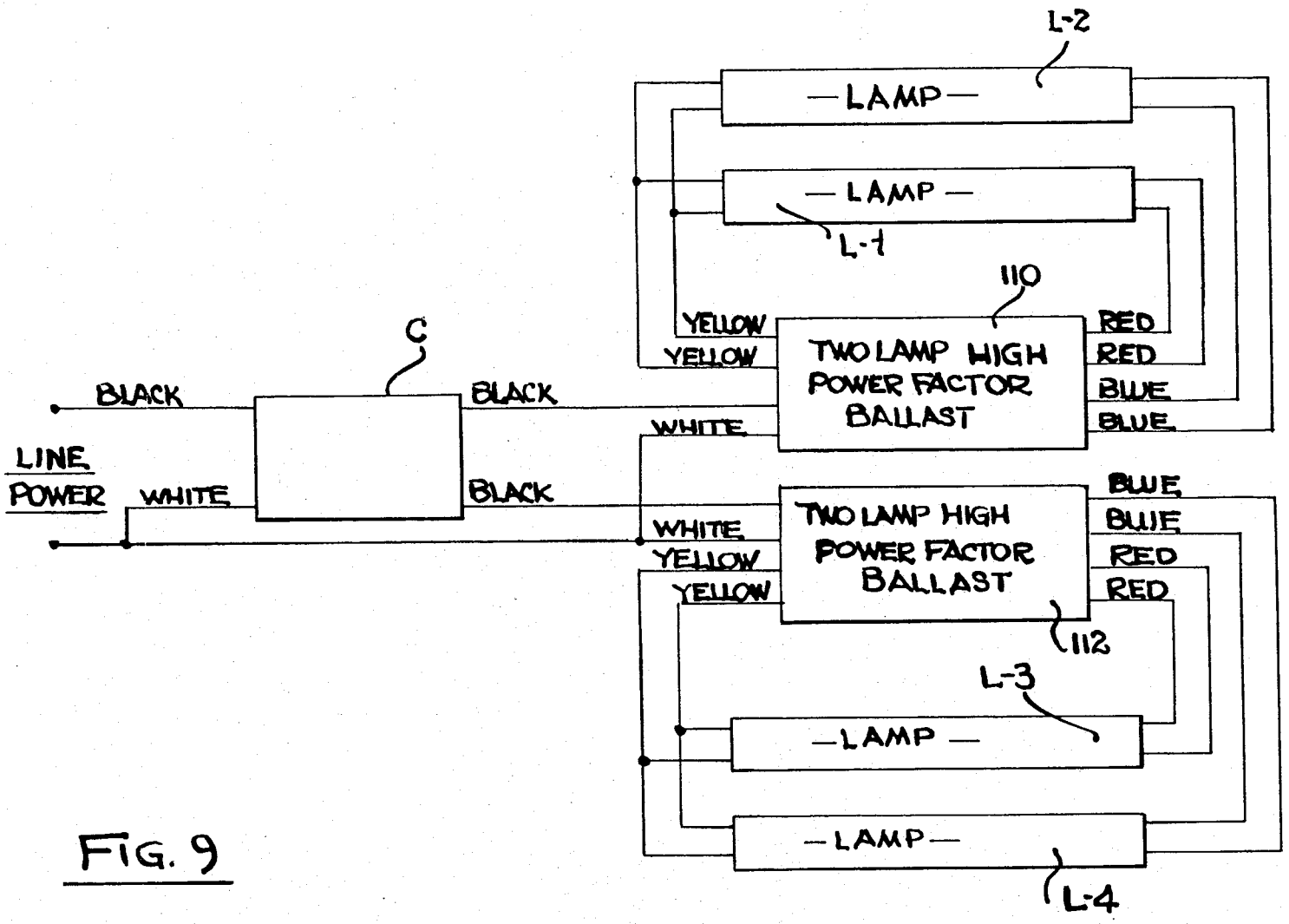
Figure 10:
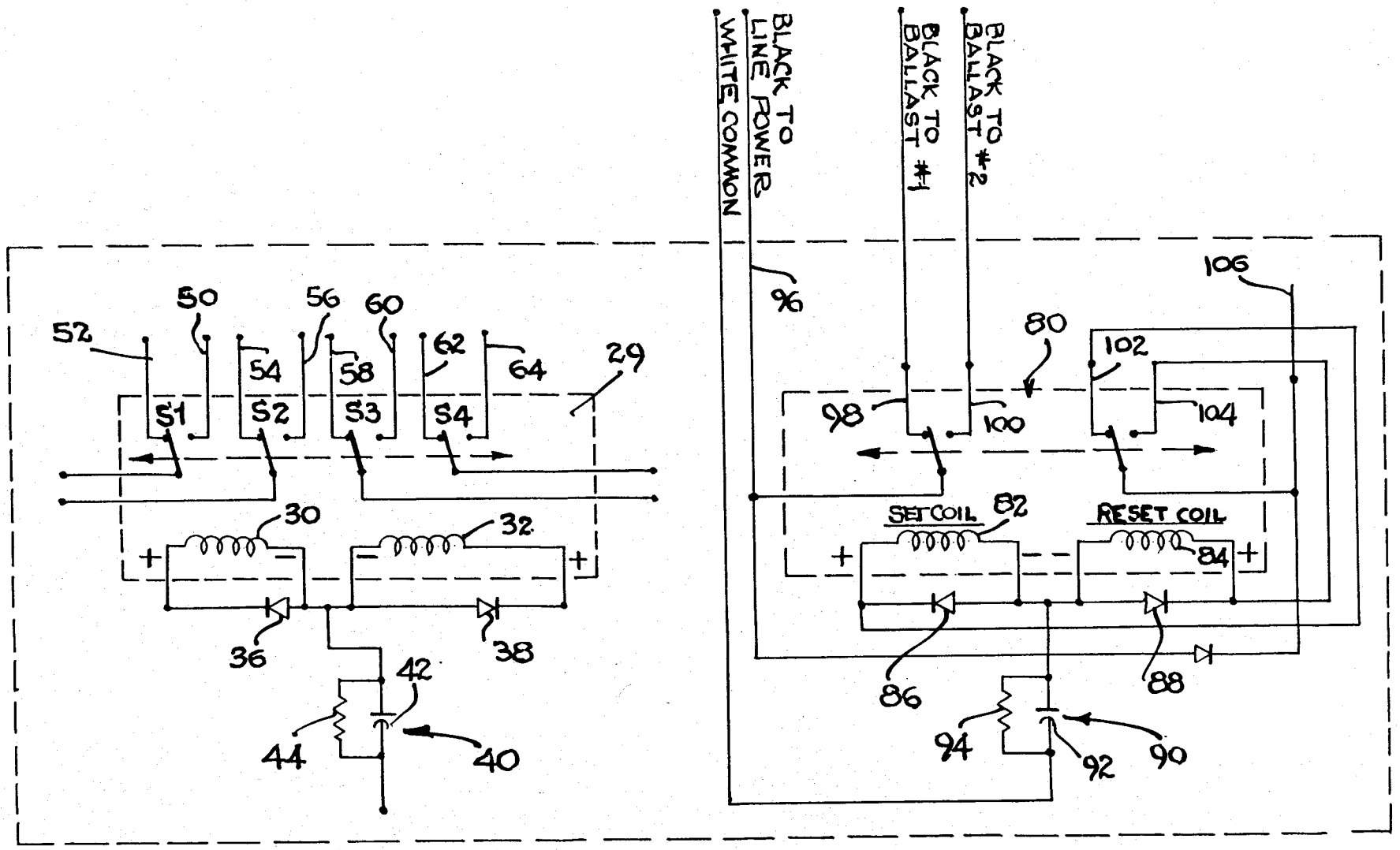
Figure 11:
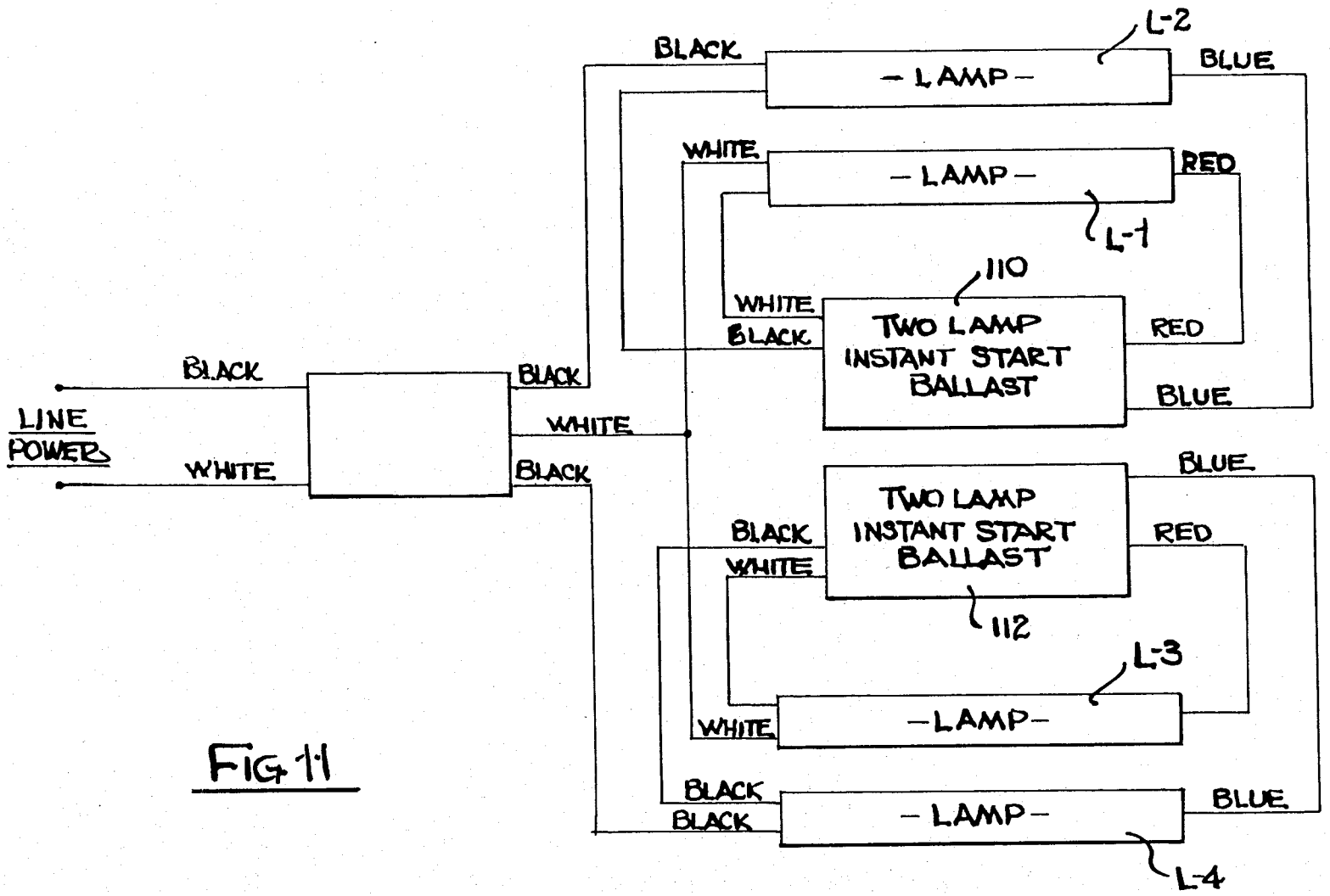
Figure 12:
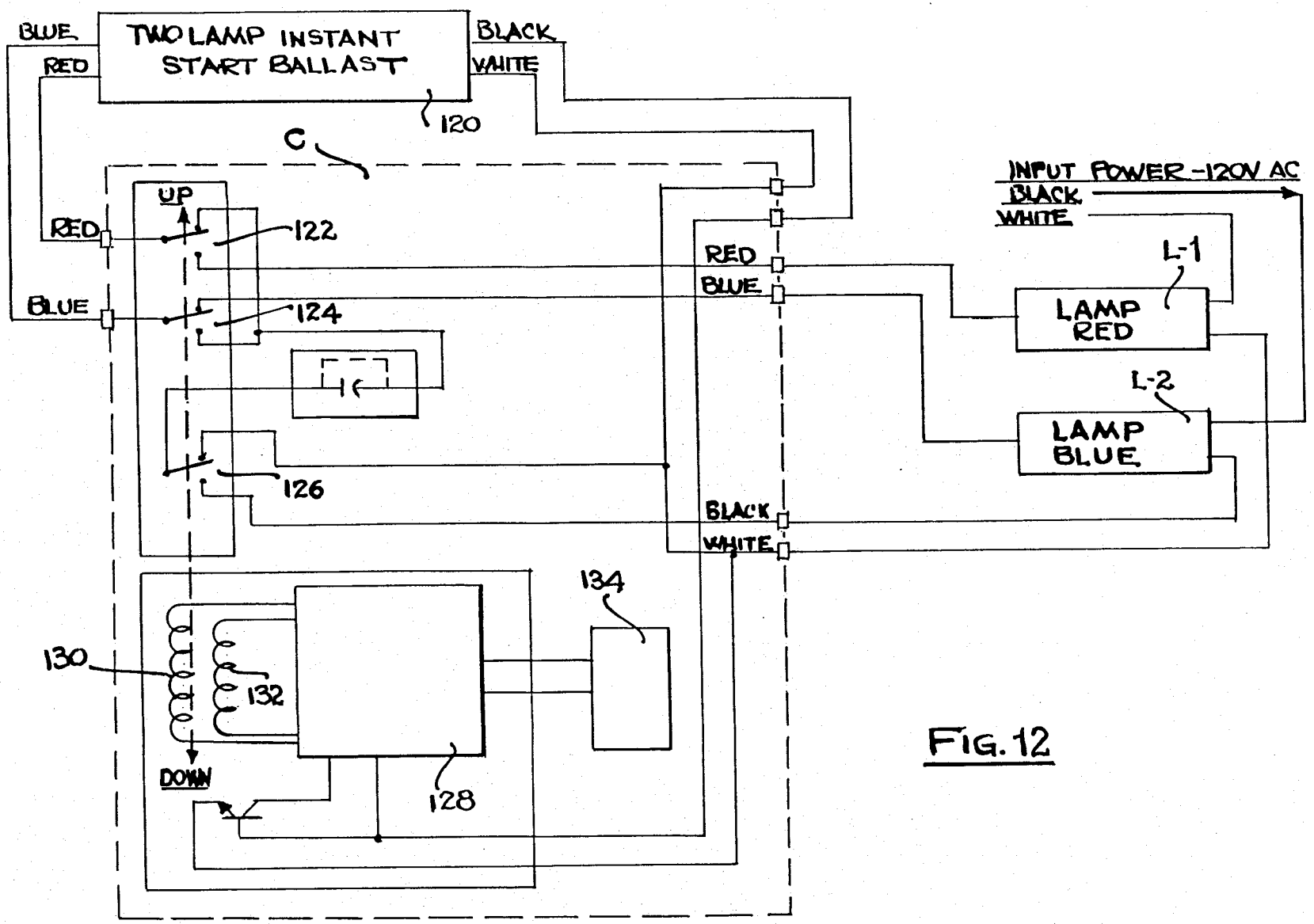
Figure 13:
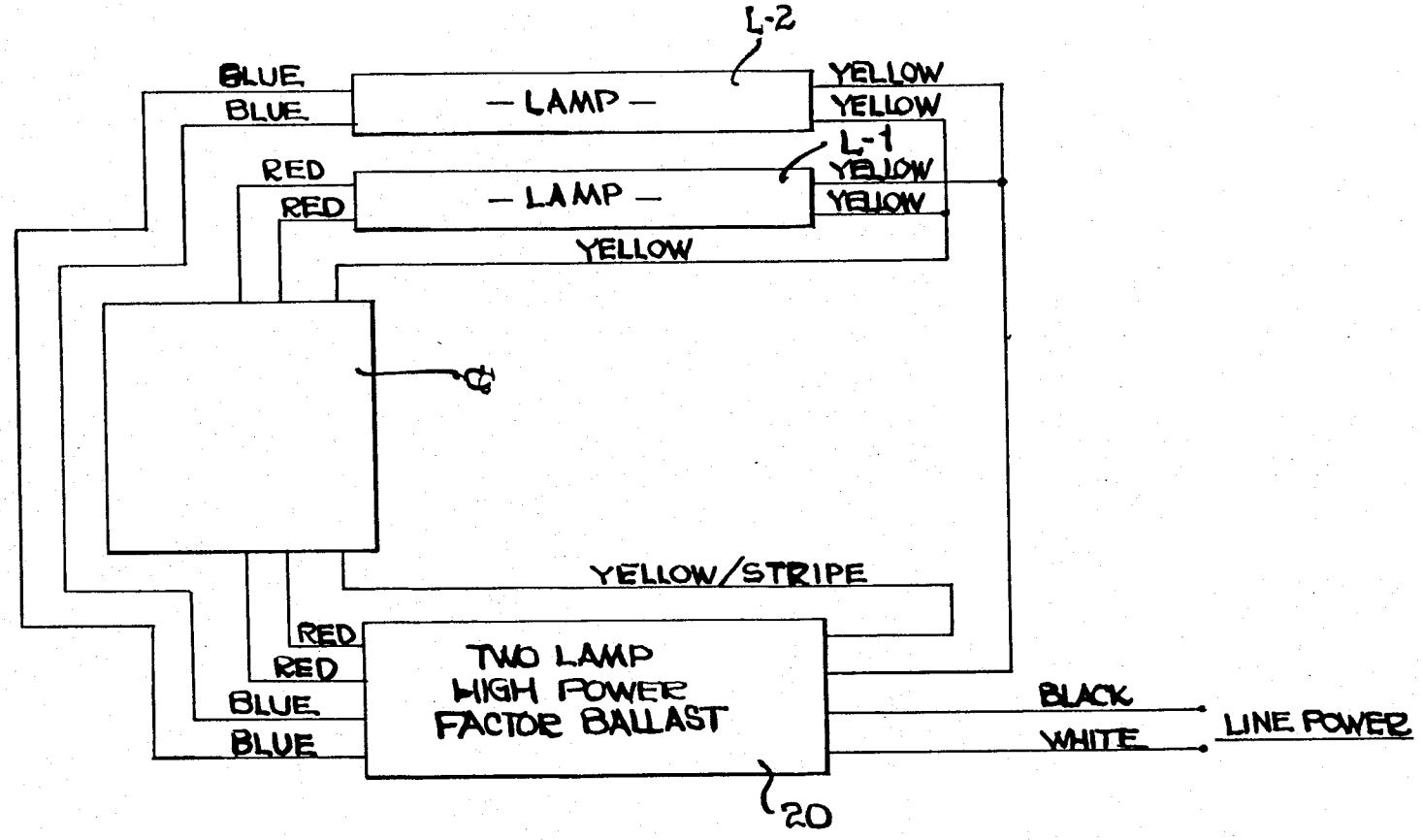
Figure 14:
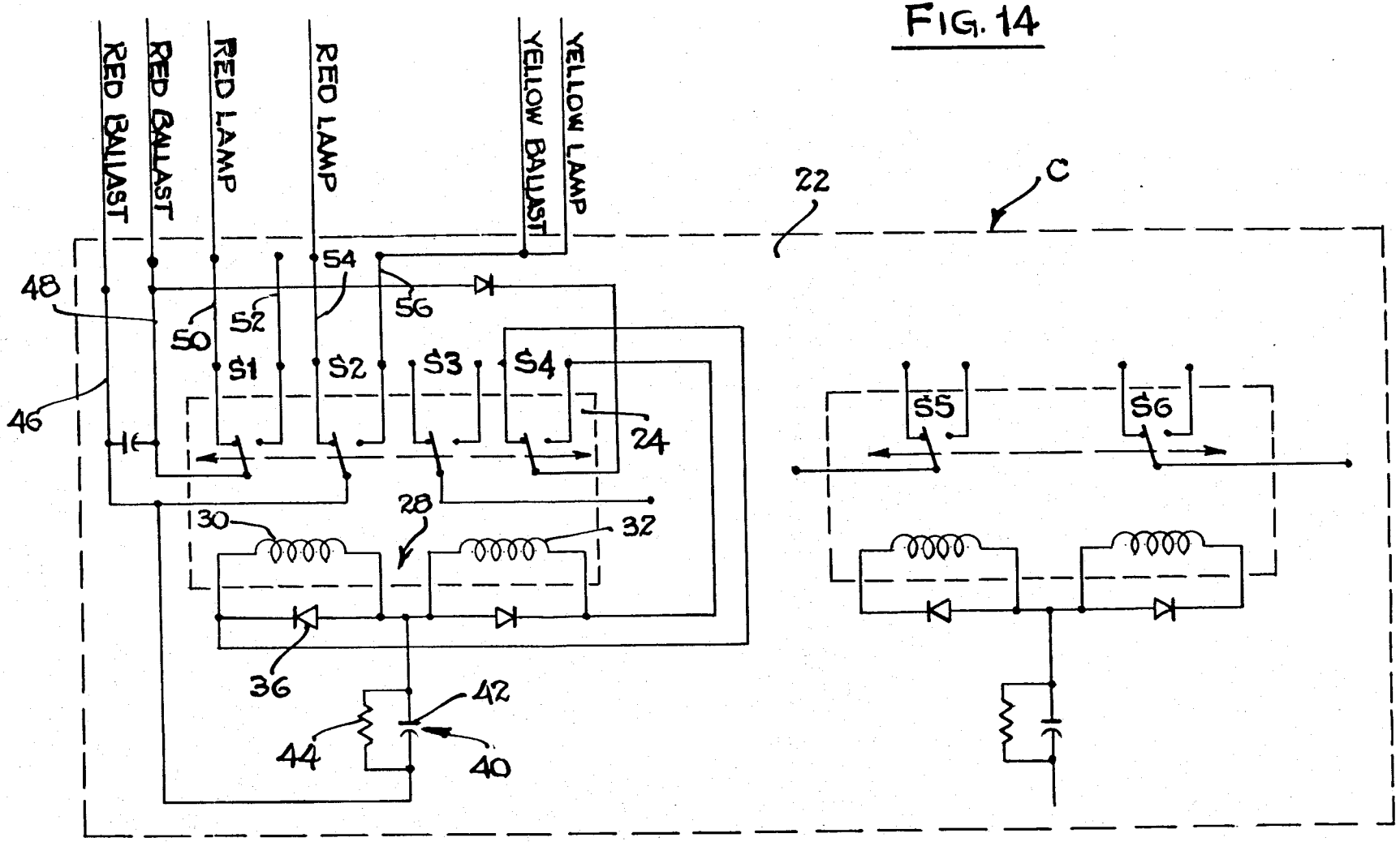
Figure 15:
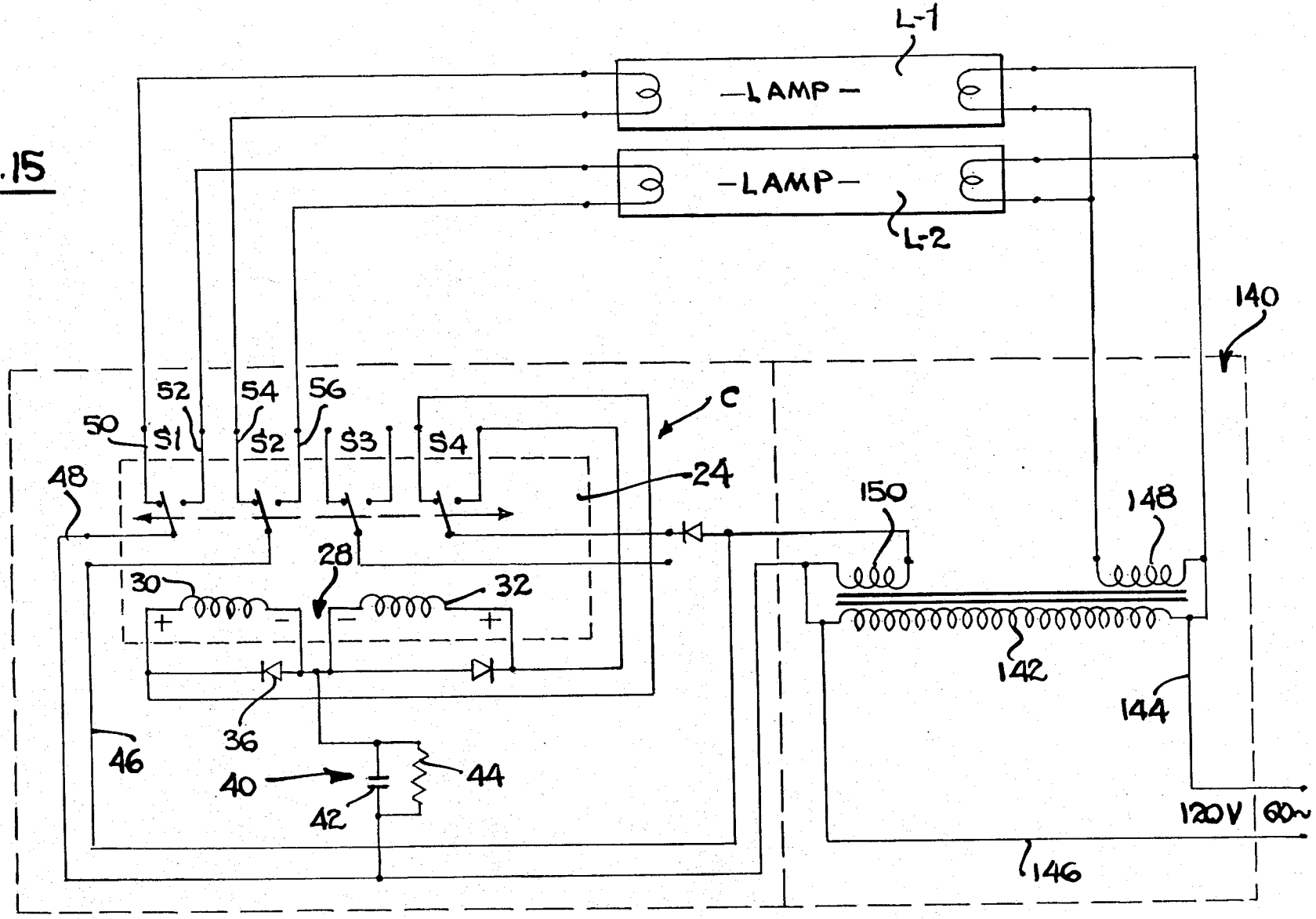

Having thus described the invention in general terms, reference will now be made to the accompanying drawings in which:

FIG. 1 is a schematic view illustrating a circuit arrangement of the circuit device of the present invention with a two lamp, high power factor ballast;

FIG. 2 is a schematic view showing the details of connection of the circuit device of the present invention in a circuit arrangement with the two lamp, high power factor, rapid start ballast of FIG. 1 and a pair of fluorescent lamps;

FIG. 3 is a schematic view illustrating a circuit arrangement of the circuit device of the present invention with a single lamp, normal power factor ballast;

FIG. 4 is a schematic view showing the details of connection of the circuit device of the present invention in a circuit arrangement with the single lamp, normal power factor ballast of FIG. 3, but operating in connection with a pair of fluorescent lamps;

FIG. 5 is a schematic view illustrating a circuit arrangement of the circuit device of the present invention with a single lamp, high power factor ballast, but operating with a pair of fluorescent lamps;

FIG. 6 is a schematic view showing the details of connection of the circuit device of the present invention in a circuit arrangement with the single lamp, high power factor ballast of FIG. 5 and the pair of fluorescent lamps connected thereto;

FIG. 7 is a schematic view illustrating a circuit arrangement of the circuit device of the present invention with a normal two lamp ballast but operating in conjunction with four lamps;

FIG. 8 is a schematic view showing the details of connection of the circuit device of the present invention in a circuit arrangement with the normal two lamp ballast of FIG. 7 operating in conjunction with four fluorescent lamps;

FIG. 9 is a schematic view illustrating a circuit arrangement of the circuit device of the present invention with a pair of two lamp, high power factor ballasts operating in conjunction with four lamps;

FIG. 10 is a schematic view showing the details of connection of the circuit device of the present invention in a circuit arrangement with a pair of two lamp, high power factor ballasts of FIG. 9 and four fluorescent lamps;

FIG. 11 is a schematic view illustrating a circuit arrangement of the circuit device of the present invention with a pair of two lamp instant start ballasts each connected to a pair of lamps;

FIG. 12 is a circuit arrangement showing a modified form of circuit device of the present invention connected to a two lamp instant start ballast and a pair of fluorescent lamps;

FIG. 13 is a schematic view illustrating a circuit arrangement of the circuit device of the present invention with a two lamp high power factor ballast, similar to the arrangement of FIG. 1, but operating in a different mode;

FIG. 14 is a schematic view showing the details of connection of the circuit device of the present invention in the circuit arrangement of FIG. 13; and FIG. 15 is a schematic circuit view showing the circuit device integrated in and forming part of a two-lamp ballast.

DETAILED DESCRIPTION OF PREFERRED EMBODIMENTS

Referring now in more detail and by reference characters to the drawings which illustrate practical embodiments of the present invention, FIG. 1 illustrates a circuit arrangement of circuit switching device C forming part of the present invention connected to a two lamp high power factor ballast 20 and a pair of fluorescent lamps designated as L-1 and L-2, respectively. The ballast 20 receives electrical power from a source thereof, over a pair of conductors designated as "black" and "white". The normal two-lamp, high power factor ballast will also have a pair of conductors designated as "Red" for operating the first lamp L-1, and a second pair of conductors designated as "Blue" for operating the second lamp L-2. It can also be observed that a single yellow lead extends from the ballast 20 to the circuit device C and then to the opposite terminals of the pair of lamps L-1 and L-2.

FIG. 2 more fully illustrates the circuit device C of the present invention. In this respect, the dotted line designated by reference numeral 22 would represent the outer casing or housing for the circuit device. It should be understood that the circuit device would normally be mounted within a housing of any suitable construction, such as a metal housing, plastic housing or the like. Moreover, the housing would contain the electical components forming part of the circuit switching device, as hereinafter described in more detail and which would normally be sealed or relatively permanently enclosed. The housing would be provided with leads extending therefrom for connection to a ballast or plurality of ballasts and to the lamps.

Referring again to FIG. 2, it can be observed that the circuit device C of the present invention comprises a switching relay mechanism 24 comprised of a switch means 26, such as a four-pole, double-throw switch assembly. The four pole, double throw switch assembly 26 normally includes individual switches S-1, S-2, S-3 and S-4. Each of these switches have a pair of contacts and each of the contacts are connected to a pair of leads which extend from the housing 22.

The switching relay mechanism 24 also includes a relay means 28 or "so-called" relay which is comprised of a first relay coil normally referred to as a "set" relay coil 30 and a second relay coil 32, normally referred to as a "reset" relay coil. It can be observed that each of the relay coils are connected to a conductor 34 which is, in turn, connected to one of the terminals of the switch S-4 forming part of the double-throw four-pull switch 26. Moreover, the relay coils 30 and 32 are connected in such manner that diodes 36 and 38 are respectively connected across the coils 30 and 32, in the manner as illustrated in FIG. 2.

Connected between the pair of diodes 36 and 38 is a resistor-capacitor circuit arrangment 40 which comprises a capacitor 42 and a resistor 44 connected across the capacitor in parallel arrangement therewith. This resistor-capacitor arrangement 40 often referred to as an "R-C circuit", is then connected to the ballast and connected to one of the switches S-2 in the manner as illustrated in FIG. 2.

The resistance-capacitive circuit arrangement 40 is designed with a resistance and capacitive value so as to provide a desired time delay. In this circuit arrangement 40 will provide a continued feedback voltage to the set relay coil 30 and the reset relay coil 32. The resisitive-capacitive circuit arrangement 42 has a time delay sufficient so that the reed of any one of the switches S-1–S-4 will reach the opposite pole before the coil is discharged. Moreover, each of the switches are magnetically operable so that the reed will magnetically latch at the opposite pole. It has been found that only about 1/10th of a second energization of any of the coils is required to obtain the desired latching effect.

More specifically, it can be observed that the four-pole double-throw switch assembly 26 has a first lead 46, which in this embodiment is connected to the ballast over a conductor designated as "Red", and a second lead 48, which in this embodiment is connected to the ballast over another conductor designated as "Red", and which are, in turn, connected at the reeds of the switches S-1 and S-2, respectively. The assembly 26 includes a third lead 50 which may be connected to the lamp L-1 over one of the conductors designated as "Red" and a fourth lead 52 which may be connected to the lamp L-2 over one of the conductors designated as "Blue". The switch reed for this switch S-1 is connected directly to the ballast over one of the "Red" conductors 48 from the circuit device C to the ballast 20.

The second switch element S-2 has a lead 54 which, in this case, may be connected to the lamp L-1 over one of the conductors designated as "Red" and another lead 56 connected to the lamp L-2 over one of the conductors designated as "Blue". In this embodiment the switch S-3 has a pair of leads 58 and 60, but which remain unconnected in the circuit. The reed of this switch S-3 also remains unconnected in this particular circuit arranement. Finally, the switch S-4 has a first lead 62 and a second lead 64 and which also extends internally within the housing 22. The leads 62 and 64 are connected to the set relay coil and reset relay coil 32 in the manner as illustrated. The switch reed of the switch element S-4 is connected to the ballast over one of the conductors designated as "red" and includes a diode 66 in the line connecting the switch reed to the ballast conductor, also in the manner as illustrated in FIG. 2.

By analyzing the circuit of FIG. 2, it can be observed that the lamp L-1 remains energized when the four pole double throw switch assembly 26 is in the position as illustrated in FIG. 2. However, it can also be observed that when power is discontinued and reapplied, the coils 30 and 32 will be initially energized to cause the switches S-1, S-2, S-3 and S-4 to shift to the opposite position. In this case, by analyzing the circuitry, it can be observed that the lamp L-2 will be energized. Each time that the power from the ballast is interrupted, the four-pole, double throw switch assembly 26 will immediately switch to its opposite condition and thereby cause energization of the opposite of the lamps.

In my U.S. Pat. No. 4,348,614, dated Sept. 7, 1982, it was taught that a capacitor of sufficient value could be utilized as a substitute for one of the lamps in a plural lamp fixture. Thus, if one of the lamps in a two lamp fixture were removed, the remaining lamp would not operate properly or efficiently. However, that problem was overcome by the use of a capacitive element inserted in place of the removed lamp. It has also been found in accordance with the present invention that it is possible to literaly short circuit the contacts from which a lamp is removed or de-energized. By carefully examining the circuit of FIG. 2, it can be observed that a blue conductor from the ballast may be connected to the yellow conductor which was to be connected to the lamp which has been removed. In effect, this provides a short which takes the place of the actual capacitor and enables the remaining lamp or lamps to operate with at least the same degree of efficiency as if the any one or more lamps had not been removed.

The circuit device C of the present invention, as illustrated in FIG. 2, also has additional components which are not connected in the circuit arrangement for this particular type of two-lamp, high power factor ballast. These additional circuit components are hereinafter described in more detail in connection with the ballasts with which they would be used.

FIG. 3 illustrates a circuit arrangement of the circuit switching device C of the present invention connected to the pair of lamps L-1 and L-2 and to a single lamp, normal power factor ballast 70. However, the single lamp normal power factor ballast 70, in this case, is shown as being connected in circuit with a pair of fluorsecent lamps, such as the lamps L-1 and L-2. With reference to FIG. 3, it can be observed that only a single pair of conductors connect the circuit device C to the ballast 70. The remaining portions of the circuit arrangement are similar to those illustrated in FIG. 1. However, one of the high power ballast conductors from the source of electrical power is connected directly to one of the terminals on each of the lamps L-1 and L-2 in the manner as illustrated. Moreover, the lamps do not have one of the terminals connected to the circuit device C, but rather, they are directly to the ballast 70 in this particular circuit arrangement.

Referring now to FIG. 4, it can be observed that only the leads 46 and 48 are connected to the ballast and the leads 50, 52, 54 and 56 are connected to the lamps L-1 and L-2. By analyizing the circuit of FIG. 4, it can be observed that this circuit device will operate in a manner similar to the circuit device of FIGS. 1 and 2 with the single lamp, normal power factor ballast operating the lamps alternately.

FIG. 5 illustrates a circuit arrangement with a single lamp, high power factor ballast 74 but which is also connected to a pair of lamps L-1 and L-2. It can be observed that a circuit arrangement for connecting the circuit device C in a circuit relationship with respect to the lamps L-1 and L-2 and the high power ballast 74 is quite similar to that circuit arrangement employed in connection with FIG. 3.

FIG. 6 illustrates, in more detail, the connection of the circuit device C to the various conductors in the arrangement of FIG. 5. The leads 46, 48, 50, 52, 54, and 56 are essentially connected in the same manner as in the circuit arrangement of FIG. 2. By examining the circuitry of Figure 6, it can be observed that when the four-pole, double-throw switch assembly 26 is in the position as illustrated, the lamp L-1 will be energized and when the switch is in the opposite position, the lamp L-2 will be energized.

FIG. 7 illustrates the circuit arrangement where a two lamp ballast 76 is provided for operating the initial lamps L-1 and L-2 at one time as well as two additional lamps L-3 and L-4 alternately when power is cut-off and reapplied. Thus, the two lamp ballast 76 in the arrangement as illustrated in FIG. 7 will energize and maintain the operation of four lamps, as illustrated.

FIG. 8 more fully illustrates in detail the circuit connections of the lamp switching device C to the various lamps and the ballast 76 in the circuit arrangement of FIG. 7. In this configuration, the circuit switching device C also utilizes the additional components forming a part thereof and which was mentioned with respect to the circuit configuration of FIG. 2. The switching circuit device C comprises a pair of additional switches S-5 and S-6 as illustrated in FIG. 8, and which may constitute a double-pole, double throw switch assembly 80. The switches S-5 and S-6 are respectively operated by means of a set relay coil 82 and reset relay coil 84, in the manner as illustrated. The set relay coil 82 is connected to the lead 64 and hence, to one terminal of the switch S-4. The reset relay coil 84 is connected to the lead 62, and hence, to the other terminal of the switch S-4. Moreover, diodes 86 and 88 are respectively connected in parallel across each of the coils 82 and 84.

A resistor-capacitor circuit 90 is similarly connected to the coils 82 and 84 in the manner as illustrated in FIG. 8 and comprises a capacitor 92 with a resistor 94 connected in parallel therewith. It can also be observed that the resistor-capicator circuit 90 is also connected to the common connection of the coils 30 and 32 and to the ballast.

The circuit switching device C of the present invention is also provided with additional leads, such as a lead 96, adapted for connection to a ballast over a conductor designated as "Blue", and additional leads 98 and 100 which are connected to the terminals of the switch S-5. A further pair of leads 102 and 104 and connected to the terminals of the switch S-6, and an additional lead 106 in also connected to the reed of the switch S-6 and again adapted for connection to a ballast.

In a circuit configuration using a two lamp ballast 76 and the four individual lamps L-1 through L-4 in the arrangement as shown in FIG. 7, the additional components forming the circuit switching device C are also connected in the manner as illustrated in FIG. 8. Thus, and for this type of arrangement, essentially all of the leads to the switches S-5 and S-6 are connected to the ballast and to the lamps. The leads to the switches S-1 through S-4 remain unconnected. It can be observed, by examining the circuit configuration of FIGS. 7 and 8, that when the switches S-1, S-2, S-3, S-4, S-5 and S-6 are in the position as illustrated in FIG. 8, lamps L-1 and L-2 will be energized. However, after power is discontinued and reapplied to the ballast 76, the switches S-1, S-2, S-3, S-4, S-5 and S-6 will all switch to the opposite postions and then the lamps L-3 and L-4 will be energized when power is reapplied.

The circuit switching device C of the present invention is highly effective in an arrangement of one ballast operating four lamps, in the manner as illustrated. In recent years, reflectors have been used in lamp fixtures which employ, for example, four individual lamps and which may be operated from a single ballast in the manner as shown in FIG. 7. Reflectors are located in the fixture and two of the lamps are removed. If the two outermost lamps are removed, or otherwise, the two innermost lamps are removed, then there is a noticeable elimination of the lamps from the fixture, even with a defuser located over the remaining lamps. While the light output with the reflectors is actually greater than that which would normally be obtained from a pair of lamps without the reflectors, the noticeable effect of the eliminated lamps is still disconcerting.

It would be desirable to disconnect one of the inner lamps and one of the outer lamps which are not adjacent to each other. However, and in many cases, this requires the removal of the entire fixture for purposes of re-wiring the fixture. The circuit device of the present invention eliminates this problem inasmuch as the lamps can be wired to the circuit device in the desired fashion so as to energize any two of the four lamps as may be required. For example, it if is desired to energize lamps one and three with lamps two and four de-energized, this can be easily accomplished by properly wiring the lamps and the ballast through the circuit device of the present invention.

FIG. 9 illustrates a circuit arrangement using the circuit switching device of the present invention connected to a pair of two lamp high power factor ballasts 110 and 112 with each operating a pair of lamps. Thus, the two lamp high power factor ballast 110 operates lamps designated as L-1 and L-2 and the two lamp high power factor ballast 112 operates lamps L-3 and L-4. Accordingly, each of the ballasts 110 and 112 normally operate an individual pair of lamps much in the same manner as if the two ballasts and associated pair of lamps were separate and apart from one another.

FIG. 10 illustrates in more detail the connection of the various components of the circuit switching device C connected to the ballasts 110 and 112 and the lamps as shown. The power line designated as "white" is connected directly to the resistive-capacitive circuit 90 and the power line designated as "black" is connected directly to the reed of the switch S-6.

In the circuit arrangements of FIGS. 9 and 10, the four pole double throw switch assembly 26 is not connected to any of the lamps or to the ballast. It can be observed that the ballasts are connected directly to the lamps in a manner in which a pair of two high power factor ballasts would be connected to two individual pairs of lamps. In this case, it is necessary only to switch between the two ballasts 110 and 112.

FIG. 11 illustrates the use of the circuit switching device C of the present invention in connection with a pair of two lamp instant start ballasts 110 and 112. In this case, it can be observed that the black electrical conductor from the source of electrical power is connected directly through the circuit switching device of the present invention to one of the pair terminals of each of two of the instant start lamps in the manner as illustrated. In like manner, the white electrical conductor from the source of electrical power is connected through the circuit switching device of the present invention to the opposite terminal of the paired terminals on the same two instant start lamps. By simple examination of FIG. 10, it can be easily observed that the wiring connection through the circuit switching device C could be achieved to easily obtain the operation of four lamps with the two instant start ballasts of FIG. 11.

FIG. 12 illustrates a circuit arrangement in which a circuit device C in accordance with the present invention is used with a two lamp instant start ballast 120. In this case, it can be observed that the electrical conductors from the power source, designated as "black" and "white" are connected through the circuit switching device C to lamps L-1 and L-2 in the manner as illustrated. Moreover, the ballast 120 is connected to the circuit device C as shown. In this embodiment of the invention, the circuit switching device C may actually employ mechanically actuable switches, such as the switch 122 the switch 124 and the switch 126.

The circuit switching device C of this embodiment of the invention, illustrated in FIG. 12, comprises a bi-stable flip-flop 128 which controls a pair of relay coils 130 and 132, in the manner as illustrated. Thus, when the bi-stable flip-flop 128 is energized in one application of the power to the lamps, it will permit the switches 122, 124 and 126 to remain in one position, as for example, the position as shown in FIG. 11. However, when power is interrupted and next applied to the circuit device C, the bi-stable flip-flop 128 will switch position and cause the relay coils 130 and 132 to move the switches 122 and 124 and 126 to the opposite positions. By tracing the circuitry in FIG. 12, it can be observed that the opposite of the lamps namely, the lamp L-2 will be energized, whereas in the previous condition, the lamp L-1 was energized.

The circuit device of FIG. 12 utilizes a bi-stable flip-flop as well as mechanically actuable switches. The circuit devices as shown in FIGS. 1–10 actually utilize solid state switching and solid state switch components. Nevertheless, the switches as shown in the circuit switching device C utilized in FIGS. 1–10, and in the other embodiments hereinafter described, actually were shown in a mechanically actuable switch form in order to facilitate the understanding in accordance with the present invention and to illustrate current flow through the various conductors.

The circuit arrangement of FIG. 12 also shows the circuit switching device C employing a 24 hour cycler 134. In this case, the 24 hour cycler is normally used to automatically change the state of the bi-stable flip-flop 128 every 24 hours. It should be understood that any time period could be employed, for this purpose. In this embodiment, the cycler 134 which operates as a type of switch, will automatically change the state of the flip-flop 132 to thereby change the position of the switches 122, 124 and 126. In this way, the switching of the switches 122, 124, and 126 will cause the opposite of the lamps L-1 or L-2 to be energized when current is next applied.

It should be understood that the 24 hour cycler 134 could be replaced by a random cycler such that it will randomly cause the bistable flip-flop 128 to change positions on a random basis. Thus, such a random cycler will cause the circuit switching device C to randomly energize one of the lamps L-1 or L-2 any time that power is applied. In this way, each of the lamps will be energized on an average of about 50 percent of the time.

FIGS. 13 and 14 illustrate an alternate arrangement of a two lamp high power factor ballast, such as the ballast 20, operating a pair of lamps L-1 and L-2. However, in this arrangement, the circuit switching device C of the present invention operates so as to cause the energization of one lamp and thereafter cause the simultaneous energization of both of the lamps L-1 and L-2 in an alternate arrangement, each time that power is re-applied to the high power factor ballast 20. In other words, only the lamp L-1 will operate as power is applied to the ballast and when power is discontinued and re-applied, both lamps L-1 and L-2 will operate.

FIG. 14 more fully illustrates in more detail the circuit arrangement using the circuit switching device C of the present invention in this circuit arrangement of FIG. 13. Thus, FIG. 14 illustrates in more detail the connection of the circuit switching device C to the pair of lamps L-1 and L-2 and the ballast 20. By examining this FIG. 14, it can be observed that only one of the lamps, namely the lamp L-1 is energized when the switches S-1 through S-4 are in the position as illustrated in FIG. 14. However, when power to the ballast is interrupted and re-applied, it can be observed that the reset relay coil 32 will be energized and will cause the reeds of the switches to shift to the opposite position. In this arrangement, it can be observed that each of the lamps L-1 and L-2 will be energized.

The circuit switching arrangement utilized in FIGS. 13 and 14 is highly effective where it is desired to obtain two levels of light in a particular room or other environment. It may be desirable to energize both lamps L-1 and L-2 in a normal work environment but to energize only one of the lights, such as the lamp L-1, when it is only desirable to obtain a background light. As an example, in the case where one or more computer monitors are being used, a bright overhead light source would tend to create glare on the computer screen. Thus, the reduced light would enable effective use of the computer monitor. The user of the environment or other room can merely obtain the desired amount of light by turning the switch which controls the light source off and on.

By virtue of using the resistive capacitive network in the circuit switching device, there is no inefficiency of operation in the one lamp or bank of lamps which remain energized when the other lamp or bank of lamps are de-energized. In essence, the resistive-capacitor network eliminates a high degree of inefficiency would otherwise result in the energization of only one lamp as opposed to a pair of lamps connected to a ballast.

The circuit switching device C of the present invention is highly unique in that it is capable of being used with several conventional lamp operating voltage circuits as for example, a 120 volt circuit to about a 600 volt circuit and with lamps of most commercially available wattage ranges. Thus, the circuit switching device of the present invention is highly useful and versatile.

In addition to the foregoing, it can also be observed that the circuit switching device C of the present invention is capable of being used with both rapid start lamps and instant start lamps and the associated ballasts which would be used for powering both such lamps.

The circuit switching device of the present invention may also be incorporated in a small compact housing which is constructed so that it will have eyelets for screws or similar mechanical fasteners, in order to be secured to a fluorescent lamp fixture. Moreover, the circuit switching device C will be manufactured primarily on a circuit board with standardized circuit components and standard circuit boards may be employed. In this way, it will be possible to produce this device at a relatively low cost. In addition, the circuit switching device C may be manufactured in the form of a cubical construction to allow for compact packaging within a container housing. It is only necessary that leads extend from the circuit outwardly from the container housing for connection to the various components of the lamp circuit in the manner as previously described.

FIG. 15 illustrates an embodiment of a circuit switching device fully incorporated in a ballast 140 and which is designed to operate a pair of lamps L-1 and L-2 in the manner as illustrated. The ballast 140 includes a primary coil 142 connected to a source of power over conductors 144 and 146. A pair of secondary coils 148 and 150 are operable by the primary coil 142, much in the same manner that a conventional ballast is constructed. For this purpose, one or more capacitors would be included within the transformer section of the ballast 140.

This ballast 140 also includes a circuit switching device C as illustrated in FIG. 15. This switching device C is similar to the previously described circuit switching device and is operated in a similar manner. Moreover, and for purposes of operating a pair of lamps in the manner as illustrated in FIG. 15, the circuit switching device C would be connected somewhat in a manner similar to that arrangement used in FIG. 2.

It should be understood that the ballast and circuit switching device incorporated, as shown in FIG. 5, therein would be packaged in a suitable housing in a manner similar to that of a conventional ballast. In this embodiment, the ballast is designed as a two lamp ballast. However, with proper wiring, this ballast could become a direct replacement for an instant start ballast, a rapid start ballast and could also be wired to operate as a high power factor ballast or a normal power factor ballast.

Thus, there has been illustrated and described a unique and novel circuit switching device and method which enables alternate operation of one or more lamps in a series of lamps to thereby reduce lumen output and correspondingly reduce power consumption. Thus, the present invention fulfills all of the objects and advantages which have been sought. It should be understood that many changes, modifications, variations and other uses and applications will become apparent to those skilled in the art after considering this specification and the accompanying drawings. Therefore, any and all such changes, modifications, and other uses and applications which do not depart from the spirit and scope of the invention are deemed to be covered by the invention which is limited only by the following claims.

Having thus described my invention, what I desire to claim and secure by letters patent is:

1. A lamp switching circuit device for connection in circuit with a plurality of relatively cold operating phosphor excitable lamps and a ballast for operation of said lamps, said lamp switching circuit device comprising:

(a) first connecting means for connecting said circuit device to said ballast and which ballast is connected to receive electrical power from a source thereof to generate lamp operating voltages therefrom, (b) second connecting means for connecting said circuit device to said phosphor excitable lamps, (c) switching means operable with said ballast for causing a lamp operating voltage from said ballast to be delivered to at least a first of a pair of lamps but not to a second of the pair of lamps, (d) relay means operatively connected to said switching means to activate the switching means to enable the delivery of the lamp operating voltage to the second one of the pair of lamps but not to the first one of the pair of lamps when the power is interrupted and again turned on to the ballast, and (e) said relay means and switching means being connected in such manner that the switching circuit device operates independently of said ballast other than to receive lamp operating voltages therefrom and independently of said lamps other than to switch lamp operating voltages relative to same, such that a failure of one or more of the lamps connected in circuit with the switching device will not interfere with normal operation of said switching circuit device.

2. The lamp switching circuit device of claim 1 further characterized in that said relay means comprises a set relay coil and a reset relay coil operable in connection with each other.

3. The lamp switching circuit device of claim 1 further characterized in that said switching means comprises a four pole double throw switch arrangement.

4. The lamp switching circuit device of claim 1 further characterized in that said plurality of lamps comprises a pair of lamps connected to a single ballast in a fixture, and said circuit device causes one of said lamps to be operated when electrical power is supplied to said ballast and causes the other of said lamps to be operated when electrical power is interrupted and next supplied to said ballast.

5. The lamp switching circuit device of claim 1 further characterized in that said plurality of lamps comprises a pair of ballasts with each ballast connected to and operating a pair of lamps, and said circuit device causes the lamps powered by one of said ballasts to be operated when power is supplied, and causes lamps powered by the other of said ballasts to be operated when power is interrupted and next supplied.

6. The lamp switching circuit device of claim 1 further characterized in that said device is operable as a retrofit device capable of being electrically interposed with respect to the lamps and the ballast.

7. The lamp switching circuit device of claim 1 further characterized in that said device is incorporated in and forms part of said ballast.

8. The lamp switching circuit device of claim 1 further characterized in that said relay means comprises a set relay coil and a reset relay coil and which are alternately energized each time power is turned on to the ballast.

9. The lamp switching circuit device of claim 8 further characterized in that a resistive-capacitive network is connected to said relay coils.

10. A circuit arrangement for relatively cold operation of phosphor excitable lamps in a plural lamp system of such lamps in a manner to reduce power consumption and correspondingly reduce lumen output, said circuit arrangement comprising:

(a) a ballast having means for connection to a source of electrical power to provide lamp operating power sufficient for operation of phosphor excitable lamps, (b) a plurality of relatively cold operating phosphor excitable lamps capable of connection to said ballast to receive electrical power to enable starting of said lamps and to enable operation of said lamps, (c) switching means operable with said ballast for causing a lamp operating voltage from said ballast to be delivered to at least a first of a pair of lamps but not to a second of the pair of lamps, (d) relay means operatively connected to said switching means and forming a switching circuit arrangement therewith to activate the switching means to enable the delivery of the lamp operating voltage to the second one of the pair of lamps when the power is interrupted and again turned on to the ballast, and (e) said relay means and switching means being connected in such manner that the switching circuit arrangement operates independently of said ballast other than to receive lamp operating voltages therefrom and independently of said lamps other than to switch lamp operating voltages relative to same, such that a failure of one or more of the lamps connected in circuit with the switching circuit arrangement will not interfere with normal operation of said switching circuit arrangement.

11. The circuit arrangement of claim 10 further characterized in that said relay means comprises a set relay coil and a reset relay coil operating in combination with each other.

12. The circuit arrangement of claim 10 further characterized in that said switching means comprises a four pole double throw switch.

13. The circuit arrangement of Claim 10 further characterized in that said plurality of lamps comprises a pair of lamps connected to a single ballast in a fixture, and said circuit device causes one of said lamps to be operated when electrical power is supplied to said ballast and causes the other of said lamps to be operated when electrical power is interrupted and next supplied to said ballast.

14. The circuit arrangement of claim 10 further characterized in that said plurality of lamps comprises a pair of ballasts with each ballast connected to and operated by a pair of lamps, and said circuit device causes the lamps powered by one of said ballasts to be operated when electrical power is supplied, and causes lamps powered by the other of said ballasts to be operated when electrical power is interrupted and next supplied.

15. A switching circuit for connection between a plurality of phosphor excitable lamps and at least one ballast for operation of said phosphor excitable lamps, said switching circuit comprising:

(a) a first pair of leads extending from said switching circuit adapted to be connected to a first lamp of said plurality of lamps, (b) a second pair of leads extending from said switching circuit adapted for connection to a second lamp of said plurality of lamps, (c) a third pair of leads extending from said switching circuit corresponding to the first pair of leads and adapted to be connected to a first voltage source at said ballast, (d) a fourth pair of leads extending from said switching circuit corresponding to the second pair of leads and adapted to be connected to a second voltage source at said ballast, (e) a first pair of switches connected across two of said first and second pairs of leads, (f) a second pair of switch is connected across the other two of the first and second pairs of leads, and (g) a relay coil operatively connected to one of the leads and causing operation of said switches to cause electrical power to be supplied to one of said lamps when the power from the ballast is applied to the lamps and alternately causing electrical power to be supplied to the other of said lamps when power is interrupted and next applied to the ballast.

16. The switching circuit of claim 15 further characterized in that a pair of relay coils are connected to one of the leads to cause operation of said switches.

17. The switching circuit of claim 16 further characterized in that the relay coils are connected to one of the third or fourth pair of leads.

18. The switching circuit of claim 16 further characterized in that one of said relay coils is a set relay coil and the other of said coils is a reset relay coil.

19. The switching circuit of claim 16 further characterized in that a diode is connected across each of said coils.

20. The switching circuit of claim 16 further characterized that a resistive-capacitor network is connected to said coils and to another one of the third or fourth pairs of leads.

21. A lamp switching circuit for use with a plural lamp ballast adapted for operation of a plurality of phosphor excitable lamps, said switching circuit comprising:

(a) means for enabling delivery of power which is effective for use with said lamp from said ballast at the start of energization of either of a pair of phosphor excitable lamps, (b) switching means for enabling power to be supplied to only one of said pair of lamps at any point in time such that the powered lamp generates light and the other lamp of said pair remains off, and switching means being operable in response to said means for enabling to maintain an average alternate energization of each of said pair of lamps such that on the average one of said pair of lamps is energized about fifty percent of the time and on the average the other lamps of said pair of lamps is energized about fifty percent of the time, and (c) said switching means being connected in such a manner that it operates independently of said ballast other that to receive lamp operating voltages therefrom and independently of said lamps other than for switching lamp operation voltages relative to same, such that a failure of one or more lamps connected in circuit with the switching means will not interfere with the normal operation of said switching means.

22. A lamp switching circuit device for connection in circuit with a plurality of phosphor excitable lamps and a ballast for operation of said lamps, said lamp switching circuit device comprising:

(a) first connecting means for connecting said circuit device to said ballast and which is connected to receive electrical power from a source thereof to generate a lamp operating voltage therefrom, (b) second connecting means for connecting said circuit device to said phosphor excitable lamps, (c) switching means for causing the lamp operating voltage from said ballast to be delivered to at least one of a pair of lamps but not to the other of the pair of lamps, and (d) relay means operatively connected to said switching means to activate the switching means to enable the delivery of the lamp operating voltage to both of the pairs of lamps when the power is interrupted and again turned on to the ballast and to further active the switching means to enable the delivery of the lamp operating voltage to only one of the pairs of lamps when power is again interrupted and thereafter turned on to the ballast.

23. The lamp switching circuit device of claim 22 further characterized in that said relay means comprises a set relay coil and a reset relay coil operable in connection with each other.

24. The lamp switching circuit device of claim 22 further characterized in that said switching means shorts a pair of terminals for one lamp which is de-energized.

25. A lamp switching circuit device for connection in circuit with a pair of phosphor excitable lamps and a single lamp ballast for operation of each of said pairs of lamps, said lamp switching circuit device comprising:

(a) first connecting means for connecting said circuit device to said ballast and which is connected to receive electrical power from a source thereof to generate a lamp operating voltage therefrom, (b) second connecting means for connecting said circuit device to said phosphor excitable lamps, (c) switching means operable with said ballast for causing the lamp operating voltage from said ballast to be delivered to at least one of said lamps but not to the other of the pair of lamps, and (d) relay means operatively connected to said switching means to activate the switching means to enable the delivery of the lamp operating voltage from the single lamp ballast to the opposite one of the pair of lamps when the power is interrupted and again turned on to the ballast.

26. The lamp switching circuit device of claim 25 further characterized in that said relay means comprises a set relay coil and a reset relay coil operable in connection with each other.

27. The lamp switching circuit device of claim 25 further characterized in that said switching means comprises a four pole double throw switch arrangement.

28. A switching circuit for connection between a plurality of phosphor excitable lamps and at least one ballast for operation of said phosphor excitable lamps, said switching circuit comprising:

(a) a first pair of leads extending from said switching circuit adapted to be connected to a first lamp of said plurality of lamps, (b) a second pair of leads extending from said switching circuit adapted for connection to a second lamp of said plurality of lamps, (c) a third pair of leads extending from said switching circuit corresponding to the first pair of leads and adapted to be connected to a voltage source at said ballast, (d) a first switch connected across one of said pair of leads, (e) a second switch connected across the other pair of the first and second pairs of leads, and (f) a relay coil operatively connected to one of the leads and causing operation of said switches to cause electrical power to be supplied to one of said lamps when the power is applied to the ballast and alternately causing electrical power to be supplied to the other of said lamps when power is interrupted and next applied to the ballast.

29. The lamp switching circuit device of claim 28 is further characterized in that said lamps have a first high impedance during starting and a substantially lower impedance after starting and during operation, said switching means causing delivery of a first lamp operating voltage during starting of said first lamp when it has a high impedance and causing a second and lower lamp operating voltage to be delivered to the first of the lamps but not to the second of the lamps after starting and during operation when it has a lower impedance, said circuit switching device also causing delay of the fist lamp operating voltage to the second one of the pair of lamps but not to the first one of the pair of lamps during starting of said second one of the lamps when said second one of the lamps has a high impedance and causing said second lower voltage to be delivered to the second of said lamps after starting and during operation of said second lamps while operating at the lower impedance.

30. The lamp switching circuit arrangement of claim 29 further characterized in that said lamps have a first high impedance during starting and a substantially lower impedance after starting and during operation, said switching means causing delivery of a first lamp operating voltage during starting of said first lamp when it has a high impedance and causing a second and lower lamp operating voltage to be delivered to the first of the lamps but not to the second of the lamps after starting and during operation when it has a lower impedance, said circuit switching device also causing delay of the first lamp operating voltage to the second one of the pair of lamps but not to the first one of the pair of lamps during starting of said second one of the lamps when said second one of the lamps has a high impedance and causing said second lower voltage to be delivered to the second of said lamps after starting and during operation of said second lamps while operating at the lower impedance.

* * * * *